United States Patent [19]

Behrens et al.

[11] Patent Number: 4,948,058

[45] Date of Patent: Aug. 14, 1990

[54] APPARATUS AND METHOD FOR WINDING YARN

[75] Inventors: Reinhardt Behrens; Hans-Jochen Busch, both of Remscheid, Fed. Rep. of Germany; Reinhard Zimmermann, Charlotte, N.C.

[73] Assignee: Barmag AG, Remscheid, Fed. Rep. of Germany

[21] Appl. No.: 384,553

[22] Filed: Jul. 24, 1989

[30] Foreign Application Priority Data

Jul. 29, 1988 [DE] Fed. Rep. of Germany ..... 3825854

[51] Int. Cl.[5] ..... B65H 67/048

[52] U.S. Cl. ..... 242/18 A

[58] Field of Search ..... 242/18 A, 25 A, 56 A

[56] References Cited

U.S. PATENT DOCUMENTS

| | | | |
|---|---|---|---|
| 4,327,872 | 5/1982 | Sachleben, Sr. et al. | 242/18 A |
| 4,339,089 | 7/1982 | Dobbins | 242/18 A |
| 4,613,090 | 9/1986 | Sugioka | 242/18 A |

*Primary Examiner*—Stanley N. Gilreath

*Attorney, Agent, or Firm*—Bell, Seltzer, Park & Gibson

[57] ABSTRACT

An apparatus and method is disclosed for continuously winding a high speed running yarn onto bobbins which are serially delivered to a winding position, and wherein the rotating full bobbins are laterally moved from the winding position to a doffing position. An automatic yarn change-over mechanism is provided for transferring the running yarn from the full bobbin onto an empty bobbin which is brought to the winding position, and as part of the change-over procedure, the yarn is severed so that a free end remains on the rotating full bobbin. In order to prevent this severed yarn end from contacting and becoming entangled in the closely adjacent empty bobbin then being wound at the winding position, there is provided a plate which is pivoted into contact with the rotating full bobbin along a contact line which is located at or immediately upstream of the most narrow gap between the surface of the rotating full bobbin and that of the empty bobbin. The free yarn end is thus pressed onto the surface of the rotating full bobbin at the contact line and is thereby prevented from contacting the empty bobbin at the winding position.

11 Claims, 4 Drawing Sheets

APPARATUS AND METHOD FOR WINDING YARN

FIELD OF THE INVENTION

The present invention relates to an apparatus and method for winding a high speed running yarn onto bobbins serially presented to a winding position, and without yarn stoppage or loss of yarn between bobbin changes.

BACKGROUND OF THE INVENTION

U.S. Pat. No. 4,613,090 discloses a yarn winding apparatus of the described type and which includes a bobbin revolver having two rotatably mounted spindles which are adapted to receive empty bobbins thereon. The bobbin revolver is sequentially rotated so as to bring an empty bobbin mounted on one spindle to a winding position, while moving a full bobbin mounted on the other spindle from the winding position to a doffing position. The yarn is then severed and transferred to the empty bobbin at the winding position. The patent further discloses a plate which can be moved between the empty bobbin and the full bobbin upon the full bobbin being moved to the doffing position, so as to prevent the severed yarn end on the full package from contacting the empty bobbin, or the cross wound package being formed thereon. The disclosed plate however reduces the so called parking time, which is the time available to remove a full package from the winding spindle and to return the plate to its inoperative position. Further, there also exists the risk that the yarn end of the full package may damage the plate, or that the yarn itself may be damaged.

German No. OS 31 46 263 and U.S. Pat. No. 4,339,089 disclose a yarn winding apparatus in which an air jet is directed into the gap between the full package at the doffing position and the empty bobbin at the winding position, which is for the purpose of restraining the outward radial movement of the severed yarn end on the full package. These disclosed devices however, have not proven to be highly reliable.

It is accordingly an object of the present invention to provide an apparatus and method for winding a yarn of the described type, and which overcomes the above noted problems associated with the free yarn end which is formed on the rotating full bobbin when it arrives at the doffing position.

It is a more particular object of the present invention to provide a winding apparatus and method of the described type wherein the parking time for doffing the full packages is not reduced, and wherein damage to the device or to the yarn is avoided.

SUMMARY OF THE PRESENT INVENTION

These and other objects and advantages of the present invention are achieved in the embodiment illustrated herein by the provision an apparatus and method which comprise a bobbin revolver mounting at least two bobbin receiving spindles having parallel axes, and means for sequentially rotating the bobbin revolver so that each of the spindles may be alternately moved between a winding position and a doffing position. Means provided for traversing the yarn across a bobbin which is mounted on a spindle in the winding position, and while rotatably driving such bobbin, and yarn change-over means is provided which is operable upon the revolver moving a rotating full bobbin from the winding position to the doffing position and moving an empty bobbin from the doffing position to the winding position, for transferring the running yarn being wound on a rotating full bobbin at the doffing position onto the empty bobbin at the winding position, and so as to sever the yarn and leave a free yarn end on the rotating full bobbin. Also, the apparatus includes means for contacting the surface of the rotating full bobbin at the doffing position along a contact line which is located at or immediately upstream of the most narrow gap between the surface of the rotating full bobbin and that of the empty bobbin, and so as to press the free yarn end onto the surface of the rotating full bobbin at said contact line and thereby prevent the free yarn end from contacting and becoming entangled with the empty bobbin then being wound at the winding position.

The present invention is seen to deviate from previous solutions to the above noted problems, and which are directed to preventing damaging consequences resulting from the fact that the free yarn end of the full package is freely moveable. In contrast thereto, the present invention seeks to overcome the problems by eliminating the characteristic mobility of the free yarn end. The principle of the present invention thus involves the fact that the yarn end of the full package is pressed down on the package surface of the full package before it enters into the gap, i.e., the narrowest point between the full package and the empty bobbin upon which a new cross wound package is being formed. As a result, the tendency of the yarn end to be radially flung off the still rotating full package is avoided. Also as it is pressed down, the yarn end tends to firmly adhere to the package surface, with the forces of adherence and air being adequate to retain the yarn end during the rotation of the full package. In addition, the adhesive forces which develop from the pressing down, are also large enough to avoid having the free yarn end carried along by the layers of air which rotate with the empty bobbin, or the cross wound package being formed thereon. In a preferred embodiment, the means for contacting the surface of the rotating full bobbin is a plate tangentially contacting the surface of the full bobbin along said contact line. The yarn end is ironed into the surface of the full package, firstly, by the pressure exerted by the plate and, secondly, by the air pressure which is generated in the narrow gap between the surface of the full package and the plate.

In some types of yarn winding machines, such as are disclosed for example in German No. OS 32 11 603, the yarn is guided during the doffing process into a single plane which is normal to the axis of the full package, and the yarn is then cut. In such winding machines, it will suffice that the plate rest on the full package only at the normal plane to which the yarn is guided. However, as a safety measure, and particularly in such winding machines in which the yarn is reciprocated by a traversing device until it is cut, the plate preferably extends over the entire axial length of each package. If several cross wound packages are formed on each winding spindle, the plate may also extend over the entire length of the spindle which holds the several packages.

In a preferred embodiment of the present invention, the plate is provided with a leading edge. The plate contacts and presses against the package with an area close to said leading edge and the plate and the surface of the rotating full bobbin converge toward each other at an acute angle when viewed in the direction of rotation of the full package. As a result, the yarn end is pressed down onto the package surface in a gentle manner, i.e., without having to deflect the yarn end projecting from the full package over an edge.

The plate preferably is pivotally mounted, with the stationary pivotal axis extending substantially parallel to the contact edge and upstream of the gap formed between the full package and the empty bobbin. This arrangement facilitates a reduction of the parking time of the full package. Also, the pivotal axis could be designed to be displaceable parallel to itself in such a manner that the plate can be pivoted out of the gap between the full package and empty bobbin without contacting the latter.

By shaping the plate to include an arcuate curvature in the same direction as the curvature surface of the full package, but with a larger radius, the pressing or ironing effect on the free end of the yarn may be improved. Also, such curvature facilitates having the edge of the plate contact the surface of the full package close to the narrowest gap between the full package and the empty bobbin, or the package being formed thereon.

BRIEF DESCRIPTION OF THE DRAWINGS

Some of the objects and advantages of the prevent invention having been stated, others will appear as the description proceeds, when taken in conjunction with the accompanying drawings, in which.

DETAILED DESCRIPTION OF THE PREFERRED EMBODIMENTS

Figure 1:
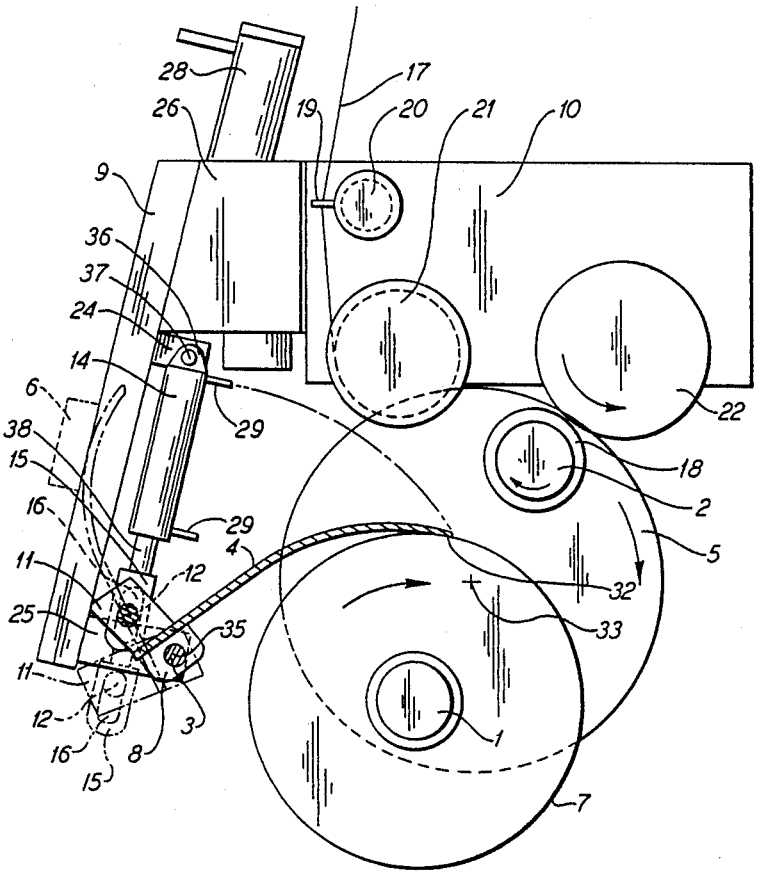
FIG. 1 is a front elevation view of a winding apparatus which embodies the features of the present invention.
Figure 2:
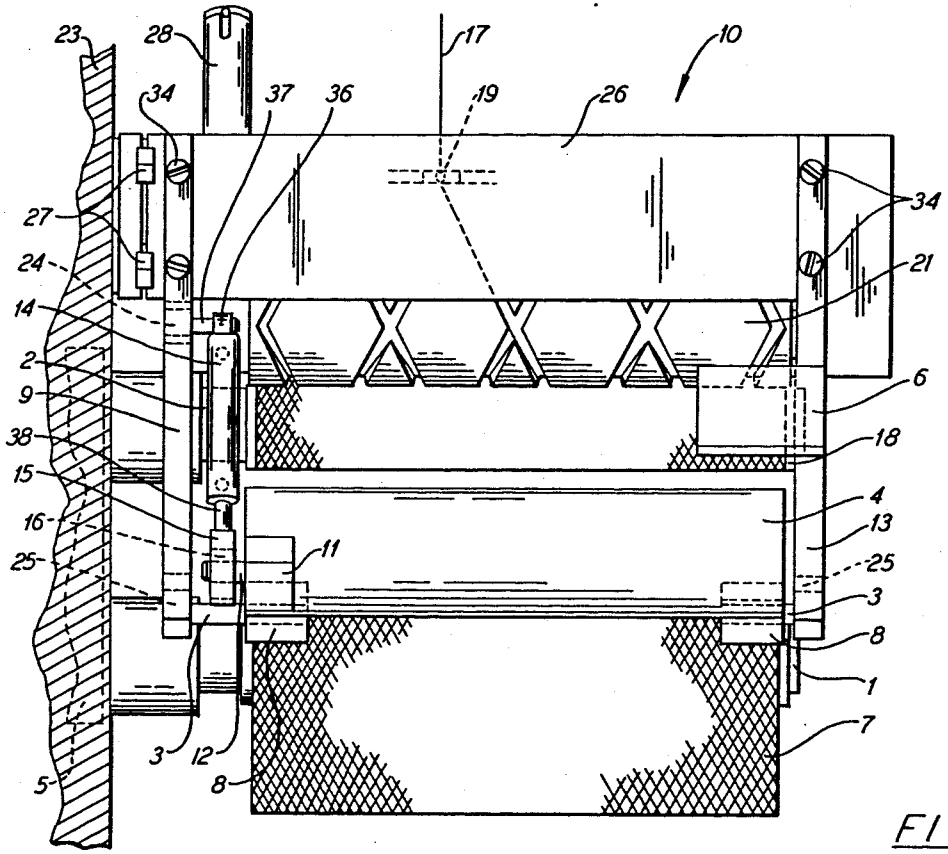
FIG. 2 is a side elevation view of the apparatus of FIG. 1.

Referring more particularly to the drawings, FIGS. 1 and 2 illustrate a winding apparatus which embodies the present invention and which is illustrated at the time of a package doff. Winding spindles 1 and 2 are rotatably supported on a rotatable revolver or turret 5, which is rotatable about a horizontal axis 33 on the machine frame 23. An electric motor (not shown) selectively drives the revolver 5.

The tubes or packages respectively which are fixed on the winding spindle in operation are in circumferential contact with a contact roll or drive roll 22. Contact roll 22 is rotatably mounted in a slide 10. The winding spindle is driven either by the circumferential contact of the empty bobbin placed on the respective winding spindle or, respectively, of the yarn package already formed thereon with contact roll 22. In this case, contact roll 22 functions as a drive roll and is driven by an electric motor (not shown), or by a drive motor (not shown) which is directly connected to the winding spindle. In the latter case, the contact roll 22 serves to measure the peripheral speed of the package and to control the rate of rotation of the axial drive motor.

In either case, the drive of the winding spindle with the full package thereon moving into and having reached its doffing or stand-by position, is driven by another axial drive motor directly connected with said spindle. This axial drive motor is operated only during change-over of the spindles from their winding position to their doffing position, if drive of the spindles in their operating position is effected by drive roll 22. If drive of the operating spindle is effected by an axial drive motor, this axial drive motor continues operation during change-over until the yarn has been caught by the empty bobbin.

Besides the drive roll 22, the slide also accommodates the traversing device for a yarn 17, which, in the present embodiment, comprises a traversing yarn guide 19 driven by a cross spiralled roll 20 and a grooved roll 21. The grooved roll 21 follows the traversing yarn guide 19, when viewed in the direction of the advancing yarn. Traversing blades, such as are known from, for example, U.S. Pat. No. 4,505,436 may be substituted for the combination of a traversing yarn guide 19 and cross spiralled roll 20.

Both the slide 10 accommodating the yarn traversing device and the drive roll and the winding spindles 1 and 2 project in cantilever fashion from the front of the machine frame 23. The slide 10 is slidably mounted on the machine frame 23 and adapted to be raised and lowered relative to the revolver 5. The arrangement of the yarn traversing device and the drive roll in the slide, the arrangement of same in the machine frame, and the arrangement of the support with the winding spindles are illustrated and described in greater detail in German AS No. 23 64 284.

On that side of the slide 10 which accommodates the yarn traversing device 19–21, there is provided a door 26 which is joined by means of hinges 27 to the end of the slide 10 facing the machine frame 23. Arranged between the door 26 and the straight guideway for the traversing yarn guide 19 are elements of a yarn change-over device, of a type well known in the art, and which are described in more detail, for example, in German AS Nos. 23 53 202; 23 64 284 or 24 61 23. The yarn change-over device is operable upon the revolver 5 moving a rotating full bobbin from the winding position to th edoffing position, and moving an empty bobbin from the doffing position to the winding position, and it acts to transfer the running yarn being wound on the rotating full bobbin at the doffing position onto the empty bobbin at the winding position. Also, as part of this change-over procedure, the yarn is severed so as to leave a free yarn end on the rotating full bobbin. A cylinder-piston unit indicated at 28 in FIGS. 1 and 2 and positioned behind the door 26 serves to drive the yarn change-over device.

In the area of the two ends of the door 26, two supporting arms 9 and 13 are mounted by means of screws 34. The free ends of the arms 9 and 13 mount bearing arms 25 which extend inwardly toward the winding spindles. The bearing arms 25 accommodate on their sides facing each other pivot pins 3 which are coaxially aligned with each other and extend substantially parallel to the winding spindles 1 and 2. Pivotally supported on these pivot pins 3 are bearing blocks 8, and the blocks 8 in turn mount a plate 4, which is welded to the blocks 8 on its side facing the winding spindles. These bearing blocks 8 have bores 35 which receive the pivot pins 3. The pivot pins can be provided with stepped diameters, not seen in the drawing, which prevent or restrict an axial displacement of the plate 4. The length of the plate 4 corresponds to at least one winding length and preferably to the entire length of the several packages placed on the associated winding spindle, and its axial location is determined in such a manner that the entire winding length is covered by the plate 4.

On the side facing away from the winding spindles 1 and 2, a post 11 is welded at the end of the plate adjacent the machine frame 23. The post 11 projects perpendicularly from the outer surface of the plate and it is provided with a guide pin 12. The guide pin 12 projects from the post 11 in the direction of the machine frame 23 and extends parallel to the pivot pins 3 and winding spindles 1 and 2.

A pneumatic or hydraulic drive is provided to carry out the pivotal movement of the plate 4 about the axis of the pins 3. The drive comprises a cylinder-piston unit 14, which is provided with a mounting eye 36. With this eye 36, the cylinder-piston unit 14 is arranged so as to pivot about a bearing pin 37, which is fixedly located on a post 24 welded to the supporting rod 9. The bearing pin 37 extends parallel to the guide pin 12 on the plate 4 and, thus, also parallel to the pivotal axis of the pins 3. At its free end, the piston rod 38 of the cylinder-piston unit 14 accommodates a head 15 with an oblong opening 16, which receives the guide pin 12. Compressed air or a pressure fluid is supplied via compressed-air or pressure fluid connections 29 to the cylinder-piston unit 14. The connections 29 can connect to a valve, which is also preferably connected with the control system of a yarn change-over device.

As shown in FIG. 1, an advancing yarn 17 is already threaded on an empty bobbin 18 and cut between the empty bobbin and the full package 7. The full package, which is no longer in circumferential contact with the contact roll 22, has reached its doffing or standby position. Up to this point of time, the spindle is driven by the drive motor (not shown) connected therewith. The circumferential speed corresponds essentially to the speed of the yarn. The empty tube is driven either by contact with the contact roll 22 or by a second drive motor (not shown) connected to said spindle and the peripheral speed also corresponds to that one of the yarn. The plate 4 includes a free edge 32 along the side which is remote from and parallel to the axis of the pins 3, and the plate rests by the action of its own weight with its pressing surface, i.e. free edge 32 on the surface of the full package 7. In so doing, the contact line extends, when viewed in the direction of movement of the full package, at or immediately upstream of the narrowest point of the gap between the full package 7 and the empty bobbin 18, or the upper layer of yarn of the cross-wound package being formed thereon. The pivot axis of the pins 3 of the plate is located upstream of the gap between the full bobbin 7 and the empty bobbin 18, and such that the plate 4 extends from the pivot axis in the rotational direction of the package 7. Also, as seen for example in FIG. 1, the plate 4 and the surface of the rotating full bobbin 7 converge toward each other at an acute angle when viewed in the direction of rotation of the full bobbin, and the plate is arcuately curved along a substantial portion of the distance from the pivotal axis to the free edge 32, with the curvature being in the direction of the curvature on the surface of the full package, but with a large radius.

As a result of these measures, the end of the yarn wound on package 7 is firmly "ironed" onto the surface of the wound yarn wrap, so that, regardless whether the full package 7 is already stopped or slows down at a reduced speed, there is no risk that the yarn end is caught by the bobbin 18, or the yarn advancing onto the same, and can become entangled with the package forming thereon. It should again be emphasized that the yarn is just pressed into the package surface as a result of the ironing effect. Consequently, even when it does not lie under the plate 4 with the package at a standstill, but is in front of the contact edge 32 of the plate, the yarn end is not separated from the package surface by the rotating layers of air, which form around the rotating empty tube 18 or the package forming thereon or around the drive roll 22.

This ironing is effected, on the one hand, by the weight of the plate. However, also the air pressure which is caused in the narrow gap between the plate and the surface of the package contributes to the ironing effect. An advantageous form of this gap is effected by the curvature of the plate which is in the same sense, however having a greater radius of curvature than the greatest curvature of the package.

It should also be noted that any contact between the plate 4 and the grooved roll 21, the empty bobbin 18, or winding spindle 2, should be avoided when pivoting the plate 4, and that the depth at which the plate 4 enters into the space between the empty bobbin 18 and the full package 7, determines the length of the parking time. Consequently, the minimum distance of the travel of the free end of the plate 4 from the empty bobbin 18 on winding spindle 2 is selected to be substantially equal to the minimum distance between the empty tube and the full package 7 on winding spindle 1.

Figure 3:
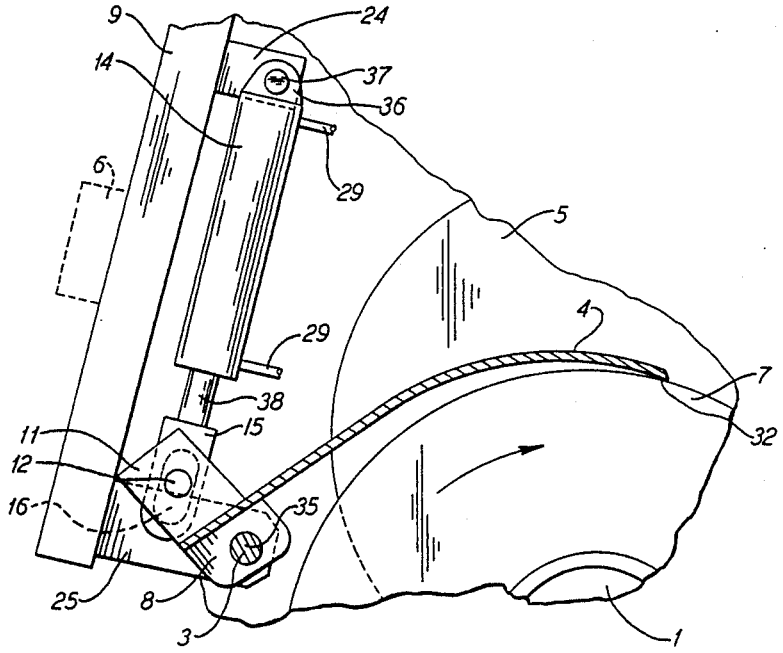
FIG. 3 is a fragmentary front elevation view corresponding to FIG. 1.

FIG. 3 illustrates the plate 4 resting in its pressing position on the full package 7. To accomplish that the plate 4 rests in this pressing position under its own weight on the package, the piston rod 38 is moved out in this position so far that the guide pin 12 is located at about the mid-point of the length of the oblong opening 16. With the help of the thus resultant lost motion path for the guide pin 12 or the piston rod 38, respectively, and the capability of the cylinder-piston unit 14 to pivot about the guide pin 37, the plate 4 is freely movable in its pressing position, so that it is not only able to rest on the package 7 under its own weight, but can also adapt itself to the thickness of the package.

It is, furthermore, possible that the plate is lifted somewhat from the surface of the package by the air pressure caused in the gap between the plate and the surface of the full package.

Figure 4:
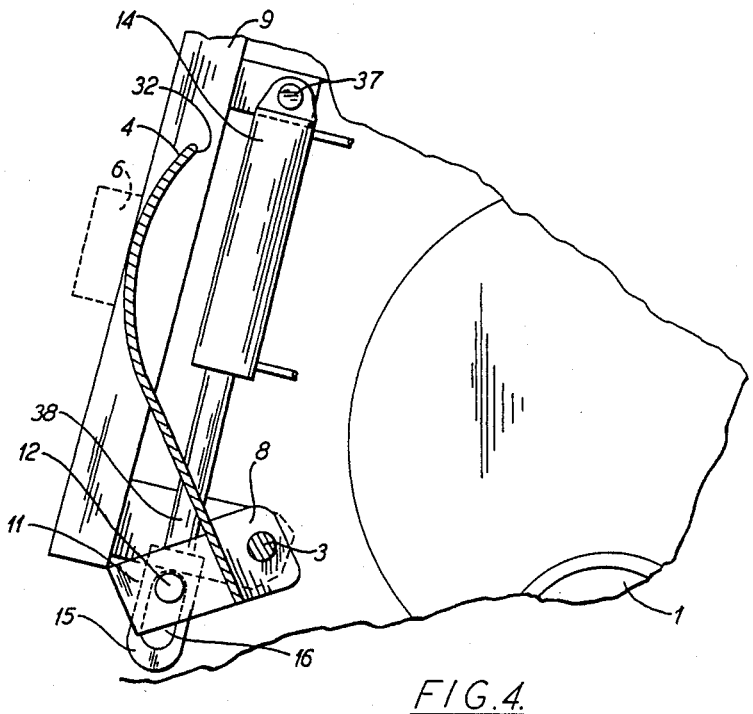
FIG. 4 is a view similar to FIG. 3 but illustrating the apparatus with the full package removed and with the contact plate being withdrawn to an inoperative position.

FIG. 4 illustrates the plate 4 in its idle or inoperative position. In this position of the plate 4, the piston rod 38 of the cylinder-piston unit 14 is moved out with its head 15 so far that the plate 4 is raised from the full package 7 and is pressed under a slight pressure against a stop 6. This slight contact pressure is accomplished in that the guide pin 12 rests on the upper end of the oblong opening 16 in the piston head 15, and that as a result thereof the hydraulic or pneumatic cylinder-piston unit 14 exerts via the piston only a small force on the guide pin 12.

The slight contact pressure under which the plate 4 rests against stop 6 prevents the plate from performing undesired vibrations during the yarn takeup operation.

Figure 5:
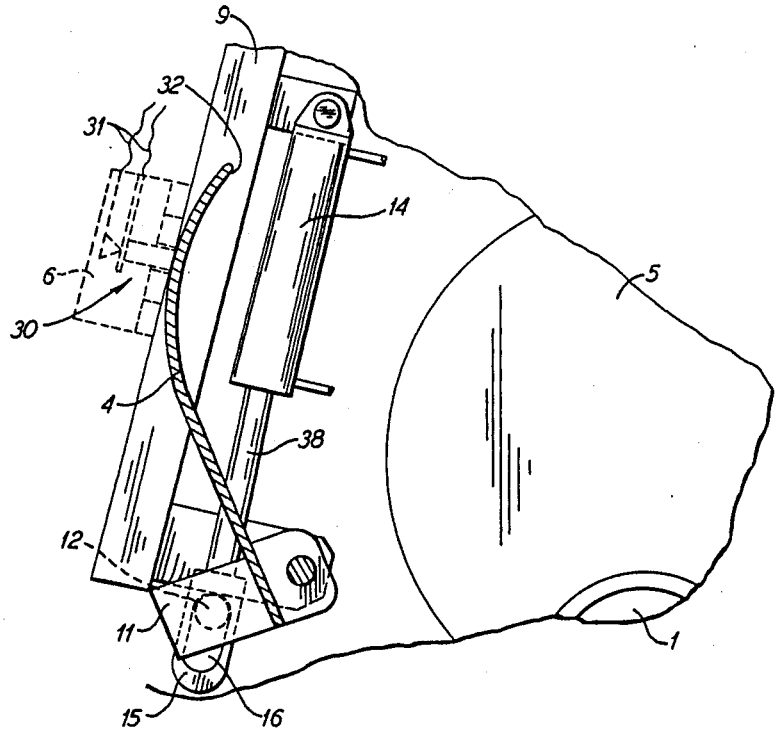
FIG. 5 is a view similar to FIG. 4 but illustrating a further embodiment of the invention.

FIG. 5 shows in dashed lines a stop 6 on the supporting rod 9. In this regard, it will be understood that the stop 6 could be arranged on the other support rod 13, or such stops could be arranged on both of the rods 9 and 13. The stop 6 shown in FIG. 5 accommodates a limit switch 30, which is actuated by the plate 4 as soon as the plate reaches its idle position. The limit switch 30 can be connected, via lines 31, for example, with the control system of the yarn change-over device, in the meaning that it detects the absence of the plate 4 in its idle position, and transmits this finding to the control system, so as to prevent an actuation of the yarn change-over device, during the time when the plate 4 is in its pressing position.

In the drawings and specification, there has been set forth a preferred embodiment of the invention, and although specific terms are employed, they are used in a generic and descriptive sense only and not for purposes of limitation.

That which is claimed is:

1. An apparatus for continuously winding a high speed running yarn onto bobbins serially delivered to a winding position and without yarn stoppage or loss of yarn between bobbin changes, and comprising a bobbin revolver mounting at least two bobbin receiving spindles having parallel axes, and means for sequentially rotating the bobbin revolver so that each of the spindles may be alternatively moved between a winding position and a doffing position, means for traversing the yarn across a bobbin which is mounted on a spindle in the winding position, and while rotatably driving such bobbin, yarn change-over means which is operable upon the revolver moving a rotating full bobbin from the winding position to the doffing position and moving an empty bobbin from the doffing position to the winding position, for transferring the running yarn being wound on a rotating full bobbin at the doffing position onto the empty bobbin at the winding position, and so as to sever the yarn and leave a free yarn end on the rotating bobbin, and means for contacting the surface of the rotating full bobbin at the doffing position along a contact line which is located at or immediately upstream of the most narrow gap between the surface of the rotating full bobbin and that of the empty bobbin, with said contact line extending along at least a portion of the surface of the rotating full bobbin in a direction parallel to the axis thereof, and so as to press the free yarn end onto the surface of the rotating full bobbin at said contact line and thereby prevent the free yarn end from contacting and becoming entangled with the empty bobbin then being wound at the winding position, said contacting means comprising a sheet-like plate having a free edge, means pivotally mounting said plate about a pivotal axis which is parallel to the axes of said spindles and such that the plate in its area of said free edge is adapted to contact the surface of the rotating full bobbin along said contact line, and such that said plate and the surface of the rotating full bobbin converge toward each other at an acute angle when viewed in the direction of rotation of the full bobbin.

2. The apparatus as defined in claim 1 wherein said pivotal axis of said plate is located on one side of the axis of the spindle supporting the rotating full bobbin at the doffing position, and with said pivotal axis being on the side of said spindle axis which is upstream of said most narrow gap when viewed in the direction of rotation of the full bobbin.

3. The apparatus as defined in claim 2 wherein said pivotal axis of said plate is located such that during pivotal movement of said plate said free edge thereof does not come closer to said empty bobbin at said winding position than said most narrow distance.

4. The apparatus as defined in claim 3 wherein said plate is arcuately curved in cross section along at least a substantial portion of the distance from said pivotal axis to said free edge, with said curvature being in the direction of the curvature of the surface of the full package, but with a larger radius.

5. The apparatus as defined in claim 1 wherein said means for contacting the surface of the rotating full bobbin further comprises drive means for selectively pivoting said plate between an operative position wherein said plate is in contact with the surface of said rotating full bobbin, and an inoperative position wherein said plate is withdrawn from said rotating full bobbin.

6. A method for continuously winding a high speed running yarn or the like onto bobbins serially delivered to a winding position, and without yarn stoppage between bobbin changes, and comprising the steps of, winding the running yarn onto a rotating first bobbin positioned at the winding position and including traversing the yarn at a location upstream of the winding position to thereby form a cross-wound package on the first bobbin, laterally moving the rotating first bobbin from said winding position to a doffing position upon the bobbin becoming full, while laterally moving an empty second bobbin from the doffing position to said winding position and rotating the empty second bobbin at said winding position, then severing the running yarn and transferring the same from the rotating full bobbin to the rotating second bobbin while leaving a free yarn end on the rotating full bobbin, pivoting a sheet-like plate having a free edge about a pivotal axis which is parallel to the rotational axis of said rotating full bobbin, and contacting the surface of the rotating full bobbin along a contact line which is located at or immediately upstream of the most narrow gap between the rotating full bobbin and the second bobbin with said free edge such that said plate and the surface of the rotating full bobbin coverge toward each other at an acute angle when viewed in the direction of rotation of the full package, and so as to press the free yarn end onto the surface of the rotating full bobbin at said contact line and thereby prevent the free yarn end from contacting and becoming entangled with the second bobbin then being wound at the winding position.

7. The method as defined in claim 6 wherein the contacting step further includes locating said pivotal axis of said plate upstream of said most narrow gap.

8. The method as defined in claim 6 wherein said contact line extends along substantially the entire surface of the rotating full bobbin in a direction parallel to the rotational axis thereof.

9. An apparatus for continuously winding a high speed running yarn onto bobbins serially delivered to a winding position and without yarn stoppage or less of yarn between bobbin changes, and comprising a bobbin revolver mounting at least two bobbin receiving spindles having parallel axes, and means for sequentially rotating the bobbin revolver so that each of the spindles may be alternatively moved between a winding position and a doffing position, means for traversing the yarn across a bobbin which is mounted on a spindle in the winding position, and while rotatably driving such bobbin, yarn change-over means which is operable upon the revolver moving a rotating full bobbin from the winding position to the doffing position and moving an empty bobbin from the doffing position to the winding position, for transferring the running yarn being wound on a rotating full bobbin at the doffing position onto the empty bobbin at the winding position, and so as to sever the yarn and leave a free yarn end on the rotating full bobbin, means for contacting the surface of the rotating full bobbin at the doffing position along a contact line which is located at or immediately upstream of the most narrow gap between the surface of the rotating full bobbin and that of the empty bobbin and above a horizontal plane through the axis of the rotating full bobbin, and so as to press the free yarn end onto the surface of the rotating full bobbin at said contact line and thereby prevent the free yarn end from contacting and becoming entangled with the empty bobbin then being wound at the winding position, and comprising a plate having a free edge, means mounting said plate for movement about a pivotal axis which is parallel to the axes of said spindles, and drive means for selectively pivoting said plate between an operative position wherein said free edge of said plate is in contact with the surface of said rotating full bobbin, and an inoperative position wherein said plate is withdrawn from said rotating full bobbin, and wherein said pivotal axis of said plate is located on the upstream side of the rotating full bobbin at the doffing position and such that said plate is generally vertical in said inoperative position and generally inclined from the vertical in said operative position so as to rest on the surface of the rotating full bobbin under the force of its own weight.

10. The apparatus as defined in claim 9 wherein said drive means includes a reciprocal driving member, and a lost motion interconnection between said driving member and said plate such that the driving member is substantially free of contact with said plate when said plate is in said operative position and so that the plate rests upon the surface of the rotating full bobbin under the force of its own weight.

11. The apparatus as defined in claim 10 wherein said plate is of sheet-like configuration.

* * * * *